United States Patent [19]

Dietz, Jr. et al.

[11] 4,039,327

[45] Aug. 2, 1977

[54] STEPWISE PROCESS FOR RECOVERING PRECIOUS METALS FROM SOLUTION

[75] Inventors: George Dietz, Jr., Watertown, Conn.; Robert M. Skomoroski, Paterson, N.J.; Robert G. Zobbi, Southbury, Conn.

[73] Assignee: American Chemical & Refining Company Inc., Waterbury, Conn.

[21] Appl. No.: 710,807

[22] Filed: Aug. 2, 1976

[51] Int. Cl.[2] ..... C22B 11/08

[52] U.S. Cl. ..... 75/108; 75/.5 A; 75/106; 75/118 R

[58] Field of Search ..... 75/108, 118 R, .5 A, 75/106

[56] References Cited

U.S. PATENT DOCUMENTS

| | | | |
|---|---|---|---|
| 1,479,542 | 1/1924 | Hirschkind | 75/106 X |
| 3,215,524 | 11/1965 | Fetscher et al. | 75/106 |
| 3,271,135 | 9/1966 | Davidoff | 75/106 |
| 3,271,136 | 9/1966 | Davidoff | 75/118 R X |
| 3,311,468 | 3/1967 | Davidoff | 75/108 |
| 3,957,505 | 5/1976 | Homick et al. | 75/108 |

*Primary Examiner*—G. Ozaki

[57] ABSTRACT

Precious metals such as gold and silver are recovered from aqueous cyanide solutions thereof by a stepwise process. The pH of the solution is, if necessary, initially adjusted to about 13 and thereafter is adjusted and maintained at 10 or above throughout the process. A "starter" carbonyl compound (e.g., formaldehyde or dextrose) which reacts with free cyanide ions is dissolved in the solution. Following this, an "accelerator" (e.g., hydrogen peroxide or a persulfate) is added and the solution is heated to aid in conversion of free cyanide ions to other chemical species. Finally, a "clarifier" (e.g., hydrazine or a hydrosulfite) is added and the elevated temperature is maintained for at least a brief period after the addition. The solution is then cooled and the elemental precious metal particles formed are allowed to settle and are separated from the supernatant solution.

12 Claims, No Drawings

STEPWISE PROCESS FOR RECOVERING PRECIOUS METALS FROM SOLUTION

BACKGROUND OF THE INVENTION

The present invention relates to the recovery of precious metals such as gold and silver from aqueous solutions thereof. Generally, the precious metals, e.g. gold, are present in the form of gold cyanide complexes such as potassium or sodium gold cyanide. Such solutions containing precious metals are obtained or are the byproducts of certain industrial processes and it is obviously economically necessary to recover the precious metals values therefrom. For example, in gold plating, sodium or potassium gold cyanide solutions are employed and it is necessary to recover residual gold from the spent plating solution. In mining or in the recovery of gold or other precious metals from scrap or waste material, the precious metal is usually leached from the ore or scrap by a cyanide solution which forms a precious metal cyanide complex. The problem dealt with by the present invention is the recovery of precious metals by precipitating them as elemental metal from solutions containing their ions.

The prior art has devoted attention to this task. For example, U.S. Pat. No. 3,271,135 shows a process for recovering gold from alkali metal gold cyanide solution in which (1) a reducing agent (alkali metal hydrosulfite of hydrazine hydrate), and (2) a compound selected from a group including water-soluble aldehydes and other carbohydrates (e.g., dextroxe and formaldehyde) are introduced into the solution. The addition is either simultaneous, or by means of a precursor compound such as sodium formaldehyde sulfoxylate which liberates both components (1) and (2). The pantentee notes that component (1) may already be present in the solution when component (2) is added. U.S. Pat. No. 3,311,468 discloses a somewhat similar process specifically for recovery of silver from cyanide solutions thereof.

Another prior art patent, U.S. Pat. No. 3,271,136 seeks to overcome the stated shortcoming of the U.S. Pat. No. 3,271,135 process, which is a tendency to redissolve the precipitated elemental gold in the cyanide solution by adding a water-soluble alkali metal alkanoate and omitting component (2).

U.S. Pat. No. 3,215,524 uses a water-soluble aldehyde both to destroy the cyanide complex and reduce the precious metal ions to elemental metal particles.

The prior art has also separately addressed itself to problems of destruction or conversion of cyannide in aqueous waste for environmental protection. For example, the DuPont Chemical Company has publicized a process under the trademark KASTONE which involves treating cyanide bearing waste water with a formulation containing formaldehyde and a peroxygen compound.

Such prior art processes, when they call for more than one reagent, generally add the reagents simultaneously or do not ascribe importance to the order of addition.

It is an object of the present invention to provide a novel, efficient and economical method for recovering precious metals from aqueous cyanide solutions thereof by first reacting free cyanide ions and then reducing the precious metal ions to elemental metal.

It is another object to provide a method of recovering precious metals from such solutions by a novel stepwise addition of a starter, an accelerator and a clarifier in the order stated.

It is a further object to provide such a method which overcomes certain problems associated with prior art methods and which requires only relatively simple equipment for its practice.

Other objects and advantages of the invention will be apparent from the following description.

SUMMARY OF THE INVENTION

In accordance with the present invention the method for recovering precious metal values from aqueous cyanide solutions thereof comprises carrying out the following steps in the sequence stated. To an aqueous alkaline solution which contains cyanide ions and precious metal ions, there is added a first material which comprises a water-soluble compound which contains at least one aldehyde group and which is reactive in alkaline aqueous solution with free cyanide ions. Then there is added to the solution a second material which is one which releases hydrogen peroxide or oxygen in alkaline aqueous solution. Thereafter, the solution is heated to a temperature of at least about 85° C for at least about one-half hour to facilitate the reaction of the cyanide ions to other chemical species. There is then added to the solution a third material comprising a reducing agent, to reduce the precious metal ions to elemental particles. The solution is maintained at a temperature of at least about 85° C for an additional period of time after the third material is added. The solution is then allowed to cool and elemental metal particles to precipitate therefrom. The supernatent solution is separated from the precipitated metal particles.

In a preferred mode of practicing the invention, an interval of time for chemical reactions to occur is provided after addition of the second material and before commencing heating of the solution. Preferably, this interval of time is at least about 15 minutes. Heating of the solution to facilitate reaction of the cyanide ions is preferably for a period of between about one-half hour to about one and one-half hours.

Certain objects of the invention are obtained by the use, in the sequence specified by the method of three kinds of materials. The first material is a water-soluble compound containing at least one aldehyde group and reactive in alkaline aqueous solution with free cyanide ions. Generally aliphatic aldehydes, aromatic aldehydes or, particularly, monosacchrides are preferred. For example, formaldehyde or dextrose are preferred.

The second material is one which releases hydrogen peroxide or oxygen in alkaline aqueous solution. Generally, peroxy compounds and persulfate compounds are convenient. Hydrogen peroxide and alkali metal persulfates, particularly sodium persulfate, are preferred.

The third material employed in carrying out the method is a reducing agent to reduce the precious metal ions to elemental metal particles. Generally, the reducing agent may be selected from hydrazine, hydrazine compounds, and hydrosulfite compounds. Sodium hydrosulfite is a preferred reducing agent.

Other objects of the invention are attained by maintaining the pH of the solution at a value of not less than 10, preferably at a pH of about 13 or higher before adding the first material and a pH of about 10 or higher before and after each addition of the second and third materials.

DETAILED DESCRIPTION OF THE INVENTION

The materials required for use in practicing the method of the invention are the first material or "starter", the second material or "accelerator" and the third material or "clarifier". Each of these plays a specific role and when used in the required sequence in the method of the invention provides efficient recovery of the precious metal values.

The precious metals (and other metals) in solution are usually in the form of cyanide complexes such as sodium silver cyanide, $Na[Ag(CN)_2]$; potassium gold cyanide, $K[Au(CN)_2]$; potassium ferri cyanide, $K_4[Fe(CM)_6]$; etc. Typically, other precious and base metal ions are also present in substantial or trace amounts. For example, platinum, palladium, rhodium, zinc, iron, cadmium, nickel, cobalt, magnesium, copper, aluminum, lead, manganese, etc., may also be present. Such polyvalent metal ions generally form cyanide complexes. "Free" cyanides, i.e., cyanides which are not bound in the metal complex, such as potassium cyanide, are also usually present.

The purpose of the first material or starter is to react with the free cyanide ions and to convert them to other chemical species such an nitrile and amide-type compounds. Such compounds do not react with metallic gold or silver as readily as do free cyanide ions and therefore the problem of redissolution of metallic precious metal is avoided or minimized. Water-soluble compounds containing an aldehyde group, such as aromatic and aliphatic aldehydes, and monosaccharides are generally satisfactory. Monosaccharides are preferable because of the irritating odor of aldehydes including formaldehydes. Dextrose in particular has another advantage in that the formation of colloidal gold particles, which tend to remain in solution and not settle, appears to be minimized when dextrose is used, particularly as compared to formaldehyde. This is a very important advantage since it tends to maximize the overall recovery of gold or other precious metal.

While not wishing to be bound thereby, it is believed that the reactions which occur in the solution upon addition of the first material are typified by the following:

1.

$$\underset{\text{(formaldehyde)}}{CN^- + HCHO + H_2O} \rightleftharpoons \underset{\text{(glyconitrile)}}{HOCH_2CN + OH^-}$$

2.

$$\underset{\text{(general aldehyde group)}}{CN^- + RCHO + H_2O} \rightleftharpoons \underset{\text{(nitrile type compound)}}{HO-\overset{\overset{CN}{|}}{\underset{\underset{R}{|}}{C}}-H + OH^-}$$

1a.

$$HOCH_2CN + H_2O \longrightarrow \underset{\text{(glycolic acid amide)}}{HOCH_2CONH_2}$$

2a.

$$HO-\overset{\overset{CN}{|}}{\underset{\underset{R}{|}}{C}}-H + H_2O \longrightarrow \underset{\text{(amide type compound)}}{HOCHRCONH_2}$$

The free cyanide ions are seen from the above to react to form nitriles and amides. The starter material, at the pH and temperature conditions employed, does not significantly attack the precious metal cyanide complex.

The second material added is the accelerator which is essentially an oxidizing agent which releases hydrogen peroxide or oxygen in alkaline aqueous solution. The second material generally may be a peroxy or persulfate compound such as alkali metal pesulfates, alkali metal peroxides and hydrogen peroxide. These reagents release or form $H_2O_2$ and/or $O_2$ in alkaline aqueous solution. Specifically, sodium-, potassium-, and ammonium pesulfate and sodium peroxide are included.

Hydrogen peroxide, usually in the form of a water solution thereof is a useful second material. However, one difficulty with hydrogen peroxide is its tendency to cause excess foaming. Foaming is a particular problem when the solution to be treated is relatively high in free cyanides and metallic ions of other than precious metals, for example metallic ions such as iron, copper, nickel, zinc, tin, lead, etc.

The foaming problem is often so severe that hydrogen peroxide must be added slowly and in small increments. This increases time and labor costs. On the other hand, potassium persulfate ($K_2S_2O_8$, standard nomenclature, potassium peroxydisulfate) greatly alleviates the foaming problem particularly with high cyanide or metallic ion solutions as described above and for this reason is a preferred second material.

Without wishing to be bound thereby, it is believed that the reactions which occur in the solutions upon addition of the second material are typified by the following:

3.

$$CN^- + H_2O_2 \longrightarrow NCO^- + H_2O$$

4.

$$\underset{\text{(persulfate)}}{M_2S_2O_8} + 2H_2O \longrightarrow 2MHSO_4 + H_2O_2 \quad (M = Na, K, NH_4)$$

5.

$$\underset{\text{(sodium peroxide)}}{Na_2O_2} + H_2O \longrightarrow 2NaOH + H_2O_2$$

6.

$$2CN^- + O_2 + 4H_2O \longrightarrow 2NH_3\uparrow + 2CO_2\uparrow + 2OH^-$$

7.

$$NCO^- + 2H_2O \longrightarrow NH_4^+ + CO_3^=$$

8.

$$CN^- + 3H_2O \longrightarrow HCOO^- + NH_4OH$$

4a, 5a.

$$2H_2O_2 \longrightarrow 2H_2O + O_2$$

It will be noted that the cyanide reacts with the second material and is converted to other chemical species such as carbon dioxide, ammonia, and ammonium hydroxide.

The amount of first and second material to be added is determined by the free cyanide content of the untreated solution. The first and second materials should each be used in at least the stoichiometric amount required to react all of the initial free cyanide content of the solution. As a practical matter, an excess, say 5–50% or more, over the stoichiometric amounts should be provided both to favor complete reaction of the free cyanide ions and to provide for reactions with at least some of the cyanide ions which may be released upon destruction of the precious metal cyanide complex.

Finally, the third material or clarifier, which is a reducing agent, is added. The third material may be hydrazine, a hydrazine inorganic salt such as hydrazine -chloride, -iodide, -bromide, -sulfate, -nitrate, etc. or an alkali metal hydrosulfite. The third material, acting in a solution in which substantially all the free cyanide has been reacted, reduces the precious metal ions to elemental metal. It follows that the quantity of third material required is at least the stoichiometric amount necessary to reduce all the precious metal ions to elemental metal. As a practical matter, an excess over the stoichiometric amount is provided.

Because it is relatively easy to handle, and has been found to yield excellent results, sodium hydrosulfite is the preferred third material.

While not wishing to be bound thereby, it is believed that the reactions which occur in the solution upon addition of the third material are as follows:

9.

$$\underset{\text{(sodium hydrosulfite)}}{Na_2S_2O_4} + 2Au^+ + H_2O + O_2 + NaOH \longrightarrow 2Au^\circ\downarrow + Na_2SO_4 + NaHSO_4 + 2H^+$$

As the above reaction shows, the gold, and/or other precious metals are reduced to the elemental state and precipitate out.

In carrying out the process, a sample of the solution from which the precious metal, say gold, is to be recovered is taken and the gold content thereof is determined by conventional and well known testing means. The pH of the solution is also measured with a pH meter. If the pH of the solution is below 13 a caustic such as sodium hydroxide or potassium hydroxide should be added in amounts sufficient to raise the pH of the solution to 13 or higher. A representative sample of the solution is then taken and the free cyanide content thereof is determined by well known test means. One method of determining the free cyanide content is to add potassium iodide solution to the sample and titrate the solution with silver nitrate until an end-point showing a faint yellowish turbidity, which persists even after swirling thoroughly, is reached.

A suitable titration method is to take 10 cc of the solution and add to it 100 cc of distilled water and 5 cc of 10 percent by weight potassium iodide solution. This mixture is titrated with 0.1 N silver nitrate solution until the end point is reached. The free cyanide content of the solution in avoirdupois ounces per gallon is equal to 0.07 times cc of 0.1 N silver nitrate required in the titration. (One ounce avoirdupois per gallon is equal to 7.47 grams per liter).

With the pH properly adjusted, and the gold and free cyanide content known, addition of the appropriate material in the specified sequence may be begun.

The starter or first material, say dextrose (d-glucose) is added to the solution at room temperature with stirring or moderate agitation to promote dissolution of the first material in the solution. After the first material has dissolved in the solution, the pH should be checked. If it is below about 10, it should be adjusted to just 10 or higher with additional caustic.

The accelerator or second material is then slowly added with constant stirring or moderate agitation to disperse and/or dissolve the second material. If necessary, in order to control foaming, particularly when the second material is hydrogen peroxide, it is advisable to add the second material in increments of the total amount required, with continuous stirring. After the required amount of the second material has been added to the solution, the pH of the solution is again checked and, if necessary, adjusted to about 10 or higher. Continued stirring or moderate agitation may be carried out for a further brief period, up to about one-half hour, preferably, to promote mixture and reaction of the ingredients. The reaction scheme shown in reactions (1) – (8) is exothermic and the solution temperature may increase to as high as 60° or 70° C or more due to the evolved heat of reaction. Generally, 15 to 30 minutes is sufficient to allow these reactions to proceed before commencing heating of the solution.

After the reaction, the solution is heated by suitable means to a temperature to at least about 85° C. This temperature is maintained for a further reaction period, preferably between one-half to one and one-half hours. Thus, a total of up to about 2 hours is allowed for reactions (1) through (8) to take place, with the solution being heated through the latter major portion of the reaction period. The cyanide ions are converted to other chemical species, notably ammonia and carbon dioxide gases.

Thereafter, the clarifier or third material is added to the solution, with stirring or moderate agitation as required. After this addition, the temperature of the solution is maintained at the elevated temperature of at least about 85° C for a further brief period to promote the reduction reaction. Generally, up to about one-half hour or less, say up to 20 minutes, suffices as the period during which the elevated temperature of the solution is maintained after addition of the third material.

The heating is then stopped and the solution allowed to cool as precipitated metal particles settle. The solution is allowed to stand until the supernatant liquid is clear. For a 100 gallon or larger batch this usually occurs in a matter of hours. Typically, the solution is allowed to stand overnight and is ready for separation from the precipitated metals the next morning. The supernatant liquid may be decanted from the settled metal particles. Tests show that the supernatant liquid usually contains 10 parts per million gold or less.

The process is advantageously carried out in a reactor equipped with a heater, an agitator or stirrer and an exhaust chimney and hood to carry off the evolved gases.

The amounts of first, second and third materials required to most efficiently precipitate precious metals from a solution of given composition may vary somewhat but is easily determinable by small batch trials. The following table shows amounts of some materials which have proven to be satisfactory for recovering gold from a gold strip solution using the method of the invention.

Table

For recovering gold from a solution containing 7.467 grams per liter (1 oz av. per gal.) of free cyanide and 7.467 grams per liter of gold.

| Material | Amount Required Per Liter of Solution | Per Gallon of Sol. |
|---|---|---|
| (First Material) | | |
| Formaldehyde (37.5 wt. %), or | .0265 liter | .0265 gal. |
| Dextrose | 46.4 grams | 5.65 oz. troy |
| (Second Material) | | |
| Hydrogen Peroxide (35 wt % aqueous solution); or | .0265 liter | .0265 gal. |
| Potassium Persulfate, or | 55.1 grams | 6.75 oz. troy |
| Sodium Persulfate | 43.1 grams | 5.25 oz. troy |
| (Third Material) | | |
| Sodium Hydrosulfite | 39.6 grams | 4.82 oz. troy |

The amounts of first and second material required are adjusted proportionally to free cyanide content of the solution to be treated. The amount of third material is adjusted proportionally to gold content of the solution.

Some specific operating examples showing the efficacy of the present invention are as follows:

EXAMPLE 1

A 45 gallon (170.6 liter)batch of gold stipper solution has the following analysis at room temperature.

Au: 6.06 grams per liter pH: 12.7 free $CN^-$: 7.17 grams per liter

It is treated as follows:

| Time (minutes) | Steps and data |
|---|---|
| 0 | Add 4108.3 grams dextrose. |
| 5 | Add 1000 cc $H_2O_2$ (35 wt. %). |
| 10 | Add 1000 cc $H_2O_2$ (35 wt. %). |
| 55 | Solution temperature = 39.4° C. |
| 57 | Add 1000 cc $H_2O_2$ (35 wt. %), strong $NH_3$ odor. |
| 63 | Solution temperature = 43.3° C. |
| 64 | Add 1000 cc $H_2O_2$ (35 wt. %). |
| 66 | Solution temperature = 46.1° C. |
| 70 | Solution temperature = 48.8° C. |
| 78 | Solution temperature = 51.7° C. |
| 83 | Add 3368.1 grams dextrose. |
| 85 | Solution temperature = 51.7° C. |
| 86 | Add 1000 cc $H_2O_2$ (35 wt. %). |
| 90 | Solution temperature = 55.6° C. |
| 100 | Heat Solution with steam. |
| 105 | Solution temperature 79.4° C. |
| 109 | Solution temperature 87.8° C. Decrease heating steam flow rate and maintain temperature at 82 - 85° C. |
| 195 | Solution temperature 83.3° C. Increase steam flow rate and raise solution temperature to 93.3° C. |
| 210 | Solution temperature 93.3° C. Add 4994.7 grams $Na_2S_2O_4$ to reactor. Gold metal became visible in solution in 1 or 2 minutes after $Na_2S_2O_4$ was added. |
| 240 | Solution temperature about 93.3° C. Steam flow rate shut off. Allow solution to stand overnight. |
| 18 hrs, 45 min. | Solution temperature 72.2° C. Decanted solution: Au less than 1 ppm. |

EXAMPLE 2

A 250 cc. silver plating bath has the following analysis:

Ag: 82.1 grams per liter

HCN: 82.1 grams per liter

STEPS AND DATA

Add 53 grams of dextrose to solution.

Heat solution to 82.2° C.

Add 21 grams of $Na_2O_2$ in small increments. Some foam and spattering. Continue heating for 15 minutes Add 10 grams $Na_2S_2O_4$. Allow solution to stand for 1 hour.

Filter off silver precipitate.

Filtered solution: Ag at 38 ppm.

As indicated by the above examples, the sequence of addition of the materials may be departed from somewhat after initial additions have been made in the prescribed sequence. For example, after addition of an incremental portion, say one-fifth or more, of the total of the first material, some of the second material may be added and then the balance of the first material. Other similar variations may be followed without departing from the scope of the invention.

What is claimed is:

1. A method for recovering precious metal values from aqueous cyandie solution comprising:

a. adding to an aqueous alkaline solution containing cyanide ions and precious metal ions a first material comprising a water-soluble compound containing at least one aldehyde group and reactive in alkaline aqueous solution with free cyanide ions;

b. then adding to the solution a second material which is selected from the class consisting of materials which release hydrogen peroxide or oxygen in alkaline aqueous solution;

c. thereafter heating the solution at a temperature of at least about 85° C for at least about one-half hour to facilitate reaction of said cyanide ions to other chemical species;

d. then adding to the solution a third material comprising a reducing agent to reduce the precious metal ions to elemental metal particles;

e. maintaining the solution at a temperature of at least about 85° C for an additional period of time after adding said third material;

f. allowing the solution to cool and said elemental metal particles to precipitate; and g. separating the supernatant solution from said precipitated metal particles.

2. The method of claim 1 further including providing an interval of time for chemical reactions to occur after addition of the second material, and before commencing heating of the solution.

3. The method of claim 2 wherein the interval of time after addition of the second material and commencement of the heating is at least about 15 minutes.

4. The method of claim 1 wherein the additional period of time for which the solution is maintained at a temperature of at least about 85° C after addition of the third material is at least about 15 minutes.

5. The method of claim 1 wherein heating of the solution to facilitate reaction of said cyanide ions is for a period of between about one-half to 1 and one-half hours.

6. The method of claim 1 wherein the first material is selected from the class consisting of aliphatic aldehydes, aromatic aldehydes and monosaccharides;

the second material is selected from peroxy compounds and persulfate compounds; and the third material is selected from the class consisting of hydrazine, hydrazine compounds and hydrosulfite compounds.

7. The method of claim 6 wherein the first material is selected from formaldehyde and dextrose and the second material is selected from hydrogen peroxide and alkali metal persulfate compounds.

8. The method of claim 7 wherein the first material is dextrose, the second material is selected from hydrogen peroxide and potassium persulfate, and the third material is sodium hydrosulfite.

9. The method of claim 1 further including maintaining the pH of the solution at a value of not less that about 10.

10. The method of claim 9 further including the step of preliminarily testing the pH of the solution and, if it is below 13, adjusting the pH to 13 or higher before adding the first material, and testing the pH of the solution before and after each addition of the second and third materials and, if it is below 10, adjusting the pH to 10 or higher.

11. The method of claim 1 wherein the first and second materials are added in at least the stoichiometric amount thereof necessary to convert the free cyanide ion content of the solution to another chemical species, and the amount of the third material added is at least the stoichiometric amount required to reduce the precious metal content of the solution to the elemental metal.

12. The method of claim 11 further including the step of preliminarily testing the solution to determine the free cyanide ion content and the precious metals content thereof and regulating accordingly the respective amounts of first, second and third materials added.

* * * * *